United States Patent [19]

Könnemann et al.

[11] Patent Number: 4,915,645

[45] Date of Patent: Apr. 10, 1990

[54] MINIATURIZED CONTACT SPRING PLUG

[75] Inventors: Alfred Könnemann, Wuppertal; Bernd Zinn, Ennepetal, both of Fed. Rep. of Germany

[73] Assignee: Grote & Hartmann GmbH & Co. KG, Fed. Rep. of Germany

[21] Appl. No.: 221,706

[22] Filed: Jul. 20, 1988

[30] Foreign Application Priority Data

Oct. 13, 1987 [DE] Fed. Rep. of Germany ..... 3734654

[51] Int. Cl.[4] ..... H01R 4/24

[52] U.S. Cl. ..... 439/417

[58] Field of Search ..... 439/391–419, 439/425, 426

[56] References Cited

U.S. PATENT DOCUMENTS 3,252,126 5/1966 Brown ..... 439/417

*Primary Examiner*—Joseph H. McGlynn

*Attorney, Agent, or Firm*—Jones, Askew & Lunsford

[57] ABSTRACT

Miniaturized contact spring plug with one or more contact elements having a spring contact area and a cable terminal area with a base web and tab-shaped two-peaked penetration terminal as well as a casing with a cover which are assembled and locked together after insertion of the contact element(s), and after insertion of the flat wire conductor(s) they are brought into a final locking position in which case the penetration terminals penetrate through the cable insulation and establish contact with the flat wire conductors and are locked securely in the cover to the casing while the insulation displacement terminal holds the insulation in a tension relief manner, characterized in that the base web and the lacing web are made of one piece and are aligned vertically in the contact element, and the casing is designed in such a way that it is very small and can be locked together very well.

16 Claims, 3 Drawing Sheets

MINIATURIZED CONTACT SPRING PLUG

This invention concerns a miniaturized contact spring plug with one or more contact elements having a spring contact area and a cable terminal area with a base connecting piece and lug-shaped, two-peak penetration terminal and with a casing and a cover that are assembled and locked together after insertion of the contact element(s) and are brought into a final locking position after insertion of the flat wire conductor(s). The penetration terminals make contact with the flat wire conductor by passing through the cable insulation and lock securely in the cover while the insulation displacement terminal holds the insulation in a strain relief manner.

Contact elements for contact spring plugs of the type according to this invention are made in one piece of a punched sheet steel part and are used to produced miniaturized plugs in appropriate plug casings that can be used for low voltage installations especially in communications technology, preferably for telephone systems. The plug casing usually consists of two parts that can be joined and locked together in assembling the plug.

A known contact element consists of a relatively narrow punched metal strip and has a contact spring arm to which a base connecting piece is attached with one insulation displacement terminal. The contact spring arm is created by curving and bending the metal strip. A lug attached to one longitudinal edge of the base connecting piece is designed so it is narrower than the length of the connecting piece and has two free side edges and one free top edge and has peaks arranged one after the other in the longitudinal direction and is bent at right angles away from the base connecting piece. This tab forms the insulation displacement terminal of the contact element, in which case the free top edge of the tab with the two peaks should pass through the insulation of one cable of a flat wire conductor.

Several such contact elements are provided in a plug block with the contact springs projecting into a plug slit and the base connecting pieces are each in contact with a flat surface of the block. The insulation displacement terminals each pass through appropriately positioned slits next to the contact surface for the base connecting piece, where these slits open into conductor holes running in the longitudinal direction of the plug block and the peaks of an insulation displacement terminal project into the conductor hole where they make contact twice by penetrating one wire of a flat wire conductor extending into a conductor hole in its longitudinal direction.

A disadvantage of this known arrangement is the side lacing of the insulation displacement terminal which exerts a torque on the longitudinal axis of the base connecting piece when pressed in so this can have a negative effect on its support, especially in the long term on the plug block. In addition, the punched metal part is only a few tenths of a millimeter thick so the buckling resistance of the insulation displacement terminal is especially low. This terminal either does not penetrate far enough into a cable and/or it bends when pressed in if too much force is applied.

Another disadvantage is that the contact element can be inserted into the plug block only when a cable has been inserted into the appropriate cable hole, because otherwise the peaks of the insulation displacement terminal projecting into the cable hole would prevent the insertion of the cable. The contact element must be processed manually as a loose part in assembling the plug, which is time consuming and requires skill.

With the plug block according German Patent OLS No. 2,753,822 only insulation displacement terminals are provided but they are not connected in one piece to a contact element. The plug block has slits with devices to assure preassembly support of the insulation displacement terminals in such a way that the peaks of the insulation displacement terminal do not project into the cable hole but sit undetachably in the respective slit. The bearing block is supplied with preassembled insulation displacement terminals. One need only insert the cables into the cable hole and press the insulation displacement terminals down. However, a disadvantage of this arrangement is that the insulation displacement terminals consisting of a thin sheet of metal project out of the plug block in the preassembly mount and the possibility cannot be ruled out that they might become damaged, e.g., bent or buckled in shipping or in handling. Once an insulation displacement terminal has been bent and aligned again it can no longer assume the required penetration force and must be replaced.

The problems mentioned here are solved by a proposal by the present applicant according to which contact strips for a plug tongue sit in a bearing block, the insulation displacement terminal webs of the contact strips project out of the bearing block and for the preassembly position of the plug they project with at least the peaks into one slit opening into a cable block of a cable block [sic] at some distance above the bearing block, in which case the slits open into cable holes and the cable block rests with snap-type locking devices on the bearing block. The insulation displacement terminal webs are protected in the preassembly position by the bearing block in the manner of a casing and cannot be bent. The cables of a flat wire conductor are pushed into the cable holes in this preassembly position of the plug, and then the cable block is pressed onto the bearing block and the insulation displacement terminal webs penetrate the cables and form a contact with them and the two blocks are locked into this end position.

Another development by the present applicant is disclosed in German Patent No. 3,340,035. The contact element known from this publication has a contact area and a cable terminal area where a lug-shaped insulation displacement terminal with two peaks is curved at the free edge away from a base connecting piece. The insulation displacement terminal is designed in a double layer and consists of two congruent individual lugs adjacent to one another. In one version the insulation displacement lugs are each connected in the upper area of the peaks with a lacing web, in which case the webs are wrapped by 180°. Hook-like teeth are provided on the front edge and the rear edge of one cutting tab. In another version one cutting tab is connected to the other cutting tab by a lacing web wrapped 180° around it, connecting the rear edge of the cutting tabs to each other. Barb-like teeth are not provided in this version.

A third version of the known contact element provides for the base web to be extended and the cutting tabs connected to the side edges. The cutting tabs are then wrapped 180° in the direction of the longitudinal plane at right angles and bent upward by 90° in the longitudinal plane. Then one cutting tab likewise has barb-like teeth.

The cutting tabs in the known version project out of a relatively broad base web or a relatively broad base plate so the contact element requires a relatively large amount of space in a plug casing. Furthermore, the barb-like teeth can be arranged on only one tab and they tend to form a furrow in the insulation of the contacting electric conductor so the desired effect of the barbs cannot be assured.

The known plug where the known contact elements are accommodated consists of a casing and cover where the cover sits on the casing so it can be snapped in place and permits preassembly as well as a final position of the cover. In the preassembly position, cables of a flat wire conductor can be inserted into appropriate cable holes in the cover. When the cover is pressed into the final position, the insulation displacement terminals of the contact elements are inserted into the respective cables of the flat wire conductor. The casing has compartments with plug openings for the contact area of the contact elements. The chamber walls of the chambers are designed to be longer than the cover wall, so boxes open toward the top are provided in the rear area of the casing to support the cable terminal area of the contact elements. The casing ends at the back with an open back front. In the area of the boxes is where the cover sits, which consists of a cuboid body with preferably round cable holes extending in the longitudinal direction of the plug cut in the body in the area of the longitudinal extent of the boxes. The cuboid body projects over the boxes or the back front of the casing toward the rear, and blind hole type slits are provided between the holes, extending over the walls in the area of the boxes in a positive locking manner. A preferably rectangular slit as seen in top view runs perpendicularly downward from each cable hole and opens into the box space and has the insulation displacement terminal passing through it. The boxes are designed so they are wider than the chambers, and the side walls and the chamber walls are kept narrower, so this results in one step each. The bottom inside surface in the area of the boxes is lower than in the area of the chambers with a tapered step provided in the transition from the chambers to the boxes, so it runs across the longitudinal direction of the plug. The cable holes in the elongated area of the cover form spaces with a rectangular cross section in the extended area of the cover. The depth of the slits is selected so the walls rest on the bottom of the slits when the cover is pressed out of the prelocking position and into the final locking position, whereby the walls already project into the slits in the prelocking position. Recesses are provided in the cover for the side walls, and the outside walls of the recesses have two indentations that are open toward the bottom and between them there is a recess that is open toward the top, thus forming a U-shaped strap as seen in the side view, and the cross piece of the strap works together with the edges of the catch lugs as a snap-type catch where the catch lugs are provided on the outside of the side walls of the casing and the cross piece can slip from above over the inclined surface of the stop lug and sits in the prelocking position of the cover under the catch edge of the upper catch lug. When the cover is pressed down into the final position, the cross piece slips over the inclined surface of the catch nose and snaps behind the catch edge of the lower catch lug and the walls abut against the bottom surface of the recesses.

The known casing assures an optimum function but it still has a relatively complex design.

The propose of this invention is to create a contact spring plug with a space saving contact element of a simple design and accordingly also a smaller plug casing with a simpler shape that provides a better snap action.

This problem is solved by the features of claims 1. Advantageous refinements of this invention are characterized in the subclaims. This invention will now be explained as an example with reference to the figures which illustrate the following:

Figure 1:
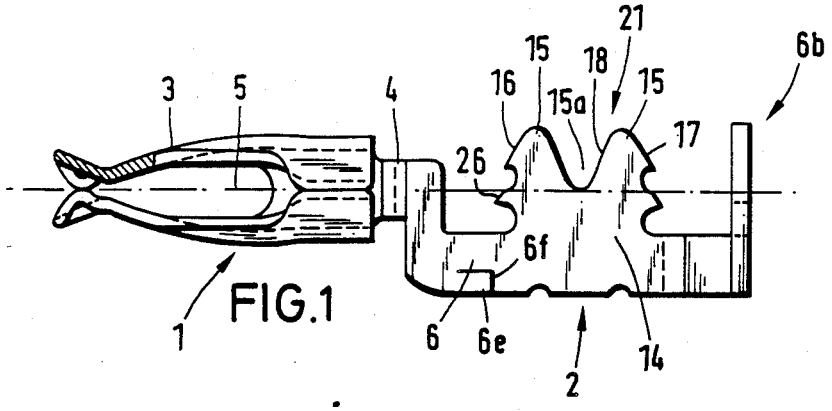
FIG. 1 shows a side view of the first version of the contact element.

A contact element for the plug according to this invention has a contact area (1) and an insulation displacement terminal area (2). The contact area (1) may be formed by a flat forked spring (3). However, it may also be a circular connector or a circular pin bushing, etc., for example. Since the shape of the contact area may conform to the usual shape of a contact spring element or contact plug or contact plug sleeve of a punched metal part, this part of the contact element according to this invention need not be described further.

It is important for the insulation displacement terminal area (2) to be connected to contact area (1) in one piece with lacing web (4), which extends in the direction of the longitudinal axis (5). Lacing web (4) is followed in the insulation displacement terminal area (2) by a flat vertical metal strip as base web (6). Lacing web (4), like base web (6), is positioned vertically (with respect to its position in the plug casing or the horizontal plane between the two forked spring arms), and base web (6) extends in the directions of the vertical longitudinal plane (**5*a*), and the lacing web (4) is bent to the side of it and thus also vertically positioned. Base web (6) is also positioned at a lower level than lacing web (4), i.e., it is beneath axis (5), whereas lacing web (4) is at the level of axis (5**).

Approximately in the middle of base web (6) a cutting tab (14) that has a front edge (16) and a rear edge (17) as well as an upper edge (18) extends upward. Tab (14) forms two peaks (15) with a recess (**15*a*) between the peaks and with the peaks arranged one after the other in the longitudinal direction in a known manner. Preferably, the front edge (16) and rear edge (17) of cutting tab (14) have barb-like teeth (23) with which insulation displacement terminal (21**) can be anchored in a slit in plug casing.

At the end of base web (6) there is a cable insulation displacement terminal device (**6*b*) with a cutting edge (6*c*) and optionally a casing supporting web (6*d*) formed by a Z-shaped bend in base web (6) on which insulation displacement terminal device (6*b***) is arranged so it is bent at a right angle.

Figure 2:
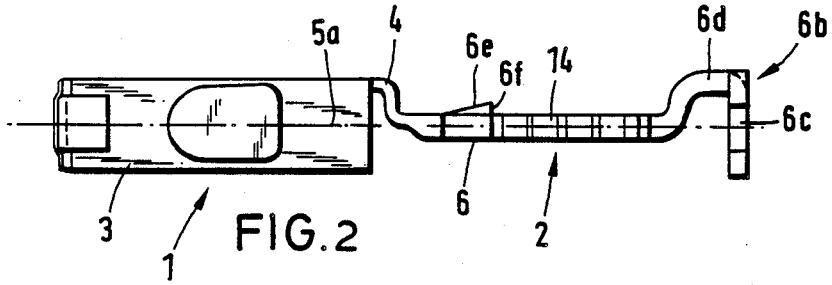
FIG. 2 shows a top view of the contact element according to FIG. 1.
Figure 3:
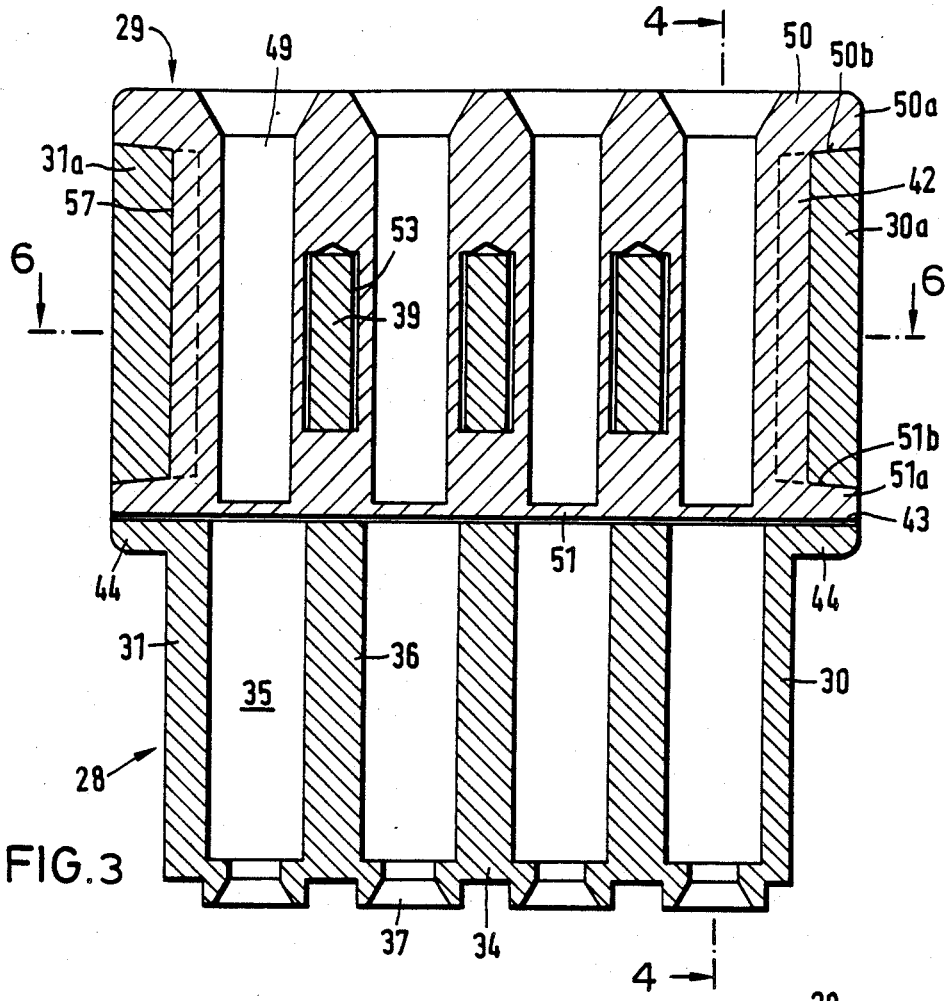
FIG. 3 shows a horizontal section through a plug.

The version according to FIGS. 1 and 2 has only the one cutting tab (14). Instead, however, the thickness of the material is greater than the thickness of the material of lacing web (4) and the contact area (1), so the required strength of the insulation displacement terminal

(21) can be assured by the thickness of the material. Preferably, the entire cable cutting area (2) is thicker than the contact area, i.e., twice as thick, for example. The contact element according to this invention has especially great flexural stiffness, can be manufactured very easily and does not pose any problems in finishing the surface of the insulation displacement terminal area (2) [sic; 21].

The contact element has a locking tongue (6*e*) in base web (6) where the tongue is formed by a vertical cut beginning at the lower edge (6*a*) and a horizontal cut in such a way that it is located in front of the insulation displacement terminal (21) and extends to the rear as far as locking edge (6*f*) and is bent out of the plane of base web (6).

The contact element according to this invention is especially suitable for mounting in a plug which consists of a casing (28) and a cover (29). Cover (29) sits on casing (28) in such a way that it can be locked in position and can assure a preassembly position (prelocked position) and a final position (final locking position) of the cover. In the preassembly position, cables, e.g., a flat wire conductor, can be inserted into appropriate cable holes and cover (29) with no interference. When the cover is pressed downed into the final locking position the vertically positioned insulation displacement terminal (21) cut into the respective cables of the flat wire conductor.

Casing (28) has two side walls (30, 31), as well as a bottom (32), a cover wall (33) and a front wall (34). Chambers (35), that preferably have a quadratic cross section, are provided in this casing which is formed by parts (30) and (34). These chambers are created by chamber walls (36) running parallel to the side walls (30, 31) and extending from the bottom (32) to the cover wall (33). Each chamber (35) is connected by a plug opening (37) in front wall (34) to the area around the plug.

The bottom (32) is designed so it is longer than the cover wall (33) and the side walls (30, 31) as well as chamber walls (36), in which case chambers (35) correspond only to the length of contact area (1) of the contact element which they receive. The cable cutting area (2) is located on the extended bottom area (32*a*). To this end, supporting webs (39) that project vertically upward at a distance from and aligned with chamber walls (36) are provided on the bottom area (32*a*) in such a way that boxes (38) are formed in the rear area of casing (28). Longitudinal grooves (40) in which base web (6) of the contact elements are inserted in a positive locking manner but preferably also with a force fit are provided in the bottom wall (32*a*) approximately in the transverse middle of each box (38) so the base web (6) and insulation displacement terminals (21) extend vertically upward parallel to the supporting webs (39).

Snap-lock walls (30*a* and 31*a*) with approximately the same height as the height of the supporting webs (39) are connected to the bottom area (32*a*) so they are inclined approximately diagonally inward and have an elastic spring action about an imaginary horizontal axis in the attachment area so they can be pivoted elastically in the direction of double arrow (41). At the upper end snap-lock walls (30*a*, 31*a*) have snap-lock strips (31) that face inward and have a steep upper slope (42*a*) and a shallower lower slope (42*b*) and the two slopes converge toward the interior of the plug. Between snap-lock walls (30*a*, 31*a*) and walls (30, 31) there is a plug slit (43) in the form of a recess. The bottom area (32*a*) is designed so it is thicker than bottom (32) by approximately the thickness of snap-lock walls (30*a*, 31*a*) so the snap-lock walls (30*a*, 31*a*) project outward and a plug web (44) that springs outward is provided to form plug slit (43).

Figure 4:
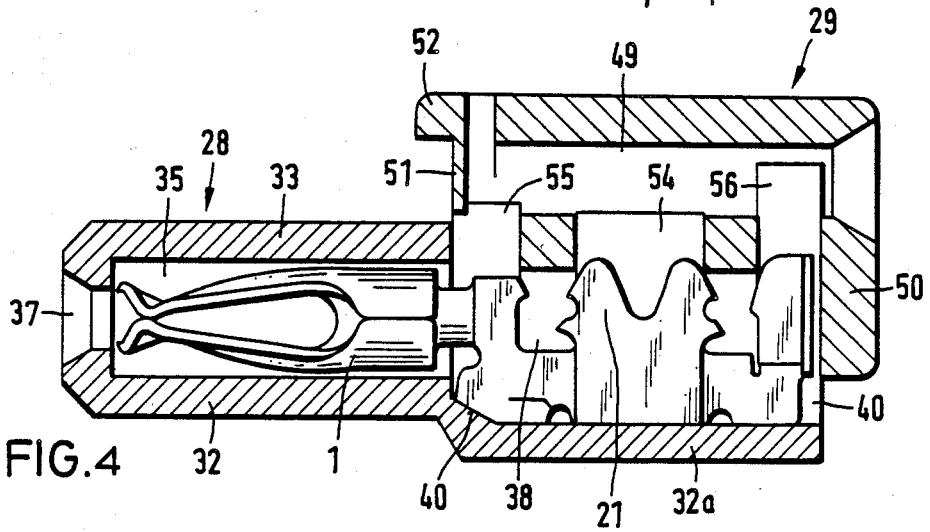
FIG. 4 shows a longitudinal section along VI—VI in FIG. 3 through one chamber of the casing with the contact element inserted (prelock position) as seen in the direction of the arrow.
Figure 5:
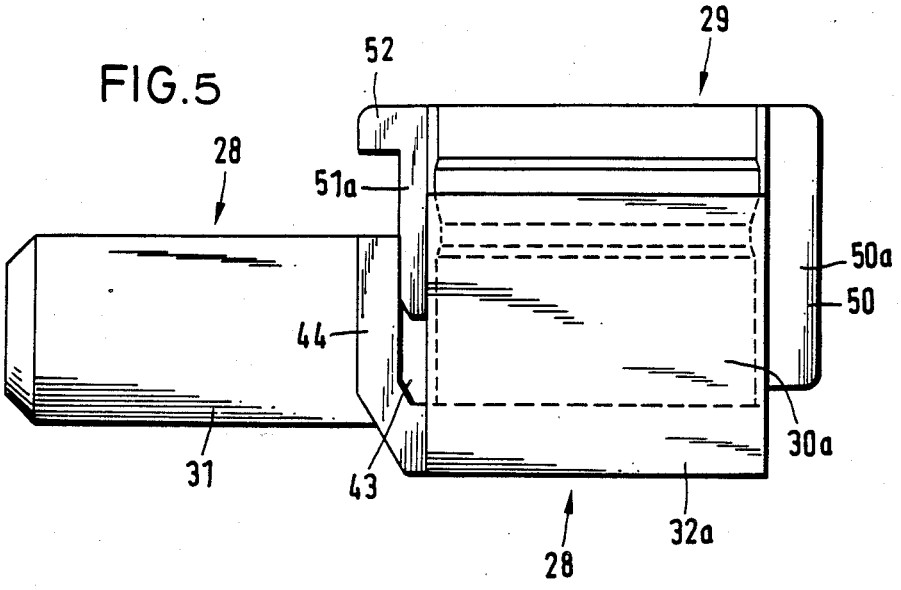
FIG. 5 shows a side view of the plug in the prelocked position.
Figure 6:
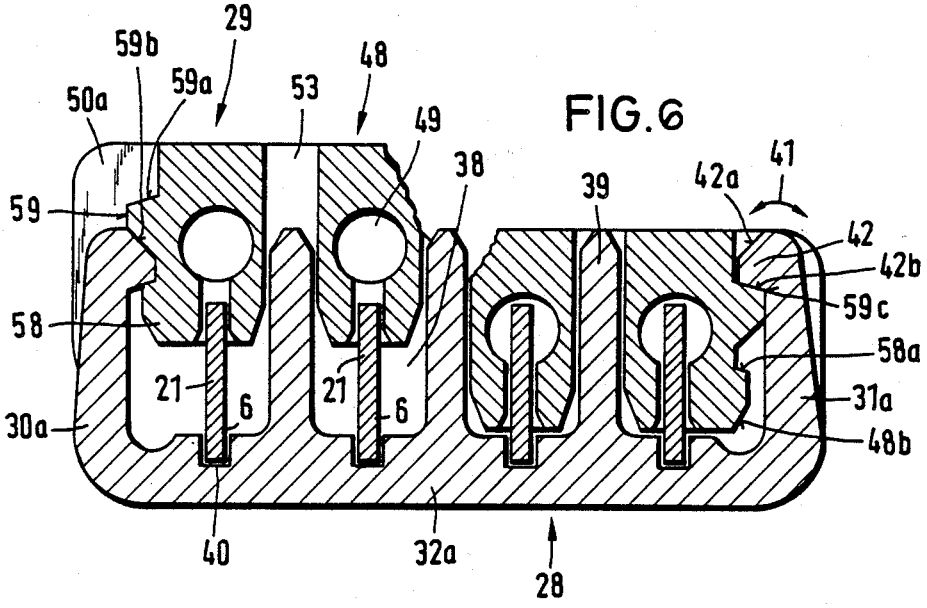
FIG. 6 shows a cross section along VIII—VIII in FIG. 3 as seen in the direction of the arrow (left side in prelocked position, right side in final locking position).

Cover (29) sits on casing (28) in the area of boxes (38). The cover consists of an essentially block-shaped body (48) in which there are preferably round cable holes (49) in the area of the longitudinal extent of the boxes running in the longitudinal direction of the plug. Body (48) projects over the boxes (38) and the back front of casing (28) toward the rear with a rear wall (50) which also extends down from the block-shaped body (48) and prevents the contact elements from falling out of the boxes in the prelocked position of the cover (29) (FIG. 4). Cable holes (49) end at the front wall web (51) which is provided at the top with a plug bordering web (52) that projects forward. Between the cable holes (49), holes (53) that run from bottom to top are provided in the block-shaped body (48) so the supporting webs (39) of casing (28) fit into them in a positive locking manner, optionally even with a force fit. Supporting webs (39) and/or holes (53) may have clamping or snap-lock devices to support the force fit.

A slit (54) through which the insulation displacement terminal (21) can slip in a positive locking manner, optionally also in a nonpositive manner, extends from each cable hole (49) perpendicularly downward approximately in the middle of the hole, in which case the lugs (23) of the insulation displacement terminal (21) are anchored in a barb-like manner in the front wall and rear wall of slit (54) in the final locking position of cover (29). In the prelocking position of cover (29) only the end areas of peaks (15) project into slit (54) (FIG. 4). Additional passages (55) and (56) in the area of cable holes (49) are provided for the lacing web (4) and the insulation displacement terminal device (6*b*) before and after slit (54).

The cube-shaped body (48) is recessed between two terminal webs (50*a* and 51*a*) extending from top to bottom, and two parallel mating snap-lock strips (58) and (59) are spaced the desired locking distance apart so they are parallel to each other in the longitudinal direction of the plug on the surface of recess (57) between the terminal webs (50*a*) and (51*a*) and they have inclined surfaces (59*a*, 58*a*) as well as (59*b*, 58*b*) which correspond to inclined faces (42*b*, 42*a*) of snap-lock strips (42) of snap-lock walls (30*a*, 31*a*), i.e., they cause the snap-lock walls to spread apart and lock in position.

Snap-lock strip (48) projects a shorter distance forward than snap-lock strip (59) so the prelocked position of the cover is easier to achieve than the final locking position.

It is advantageous that the snap-lock walls (30*a*, 31*a*) are angled inward in the locked positions and the inclined surfaces (42*b* and 49*a* [sic; 59*a*?]) descend toward the outside. Thus, the short upper edge (59*c*) of snap-lock strip (59) slides with a relatively high frictional force on the inclined surface (43*b*) with the action of the final locking forces with a lever effect thus yielding a form fit.

In addition, it is advantageous for the inside surfaces (50*b*, 51*b*) of webs (50*a*, 51*a*) to have a slight conical taper toward the inside and for the facing outer edge faces of snap-lock walls (30*a*, 31*a*) to run accordingly, so the snap-lock walls are largely prevented from slipping out of recess (57). Web (51*a*) sits in a form fitting manner between plug web (44) and snap-lock wall (30*a*, 31*a*). On reaching the final locking position, web (52) sits on the surface of cover wall (33).

The plug according to this invention is supplied with the contact elements inserted in the prelocked position. Assembly involves merely inserting cables, e.g., a flat wire conductor into cable holes (49) and pressing the cover (29) into the locked final position. This causes insulation displacement terminal (21) to penetrate through the cable and establish electric contact.

I claim:

1. Miniaturized contact spring plug with one or more contact elements having a spring contact area and a cable terminal area with a base web and a lug-shaped two-peak penetration terminal as well as a casing with a cover which can be assembled and locked together after insertion of the contact element(s) and can be brought to the final locking position after insertion of the flat wire conductor(s), and the penetration terminals penetrate through the cable insulation and form contact with the flat wire conductor, locking securely in the cover, while the insulation displacement terminal holds the insulation in a tension relief manner, characterized in that (a) the base web (6) and the lacing web (4) are aligned vertically in one piece in the contact element, (b) the bottom (32) of the chambers (35) is lengthened toward the rear in the casing and forms a bottom area (32*a*) with supporting webs (39) projecting vertically upward at a distance from the vertical chamber walls (36) with which they are aligned on the bottom (32*a*), thus forming boxes (38) in the rear area of the casing (28), and longitudinal grooves (40) are provided in the bottom wall (32*a*) approximately in the transverse middle of each box (38) so the base web (6) of the contact elements are inserted in a form fitting manner into these grooves, but preferably also with a force fit, so the base web (6) or the insulation displacement terminals (21) extend vertically upward parallel to the supporting webs (39), and the cover (29) which is designed as a cube-shaped body (48) sits on the casing (28) in the area of the boxes (38) and the cable holes (49), preferably round, running in the longitudinal direction of the plug are provided in the area of the longitudinal extent of the box, and the body (48) projects over the boxes (38) toward the rear with a rear wall (50) which also extends downward from the cube-shaped body (48) and prevents the contact elements from falling out of the boxes in the prelocked position of the cover (29), and the cable holes (49) end at the front at a front wall web (51) which is provided at the top with a plug bordering web (52) that extends forward like a collar, and between the cable holes (49) there are holes (53) in the cube-shaped body (48) running continuously from bottom to top for the supporting webs (39) of the casing (28) to be inserted into them in a form fitting manner, preferably also with a force fit, where the supporting webs (39) and/or the holes (53) preferably have clamping devices and/or snap-lock devices, and a slit (54) runs from each cable hole (49) perpendicularly downward approximately in the middle of the hole so the insulation displacement terminal (21) can slip through it in a positive locking manner, optionally also in a nonpositive manner, and the lugs (23) of the insulation displacement terminal (21) are anchored like barbs in the front wall and rear wall of the slit (54) in the final locking position of the cover (29) and additional passages (54) and (56) are provided in front of and behind the slip (54) in the area of the cable holes (49) for the lacing web (4) and the cable displacement terminal device (6*b*).

2. Contact spring plug according to claim 1, characterized in that the cable cutting area (2) is connected in one piece with a lacing web (4) in the direction of the longitudinal axis (5) at the contact area (1).

3. Contact spring plug according to claim 1, characterized in that the lacing web (4), like the base web (6), is a vertically positioned sheet metal strip.

4. Contact spring plug according to claim 1, characterized in that the base web (6) extends in the direction of the vertical longitudinal plane (5*a*) and the lacing web (4) is bent to the side of it.

5. Contact spring plug according to claim 1, characterized in that the base web (6) is located lower than the lacing web (4), i.e., it is below the longitudinal axis (5), while the lacing web (4) is at the same level of the longitudinal axis (5).

6. Contact spring plug according to claim 1, characterized in that a cutting tab (14) extends upward in the middle of the base web (6) and has a front edge (16) and a rear edge (17) as well as a top edge (18) in which case the tabs (14) form the two peaks (15) arranged one after the other in the longitudinal direction, forming a recess (15*a*) between the two peaks.

7. Contact spring plug according to claim 6, characterized in that the front edge (16) and the rear edge (17) of the cutting tab (14) have barb-like teeth (23).

8. Contact spring plug according to claim 1, characterized in that the thickness of the material of the insulation displacement terminal (21) is greater than the thickness of the material in the contact area (1).

9. Contact spring plug according to claim 8, characterized in that the total cable cutting area (2) is thicker, preferably twice as thick, as the contact area (1) including the lacing web (4).

10. Contact spring plug according to claim 1, characterized in that a cable cutting terminal device (6*b*) is provided at the end of the base web (6) with a cutting edge (6*c*) and optionally a casing supporting web (6*d*).

11. Contact spring plug according to claim 10, characterized in that the supporting web (6*d*) is formed by a Z-shaped bend in the base web (6) where the insulation displacement terminal device (6*b*) is bent at a right angle.

12. Contact spring plug according to claim 1, characterized in that a snap-lock tongue (6*e*) formed by a vertical cut beginning at the lower edge (6*a*) and a horizontal cut is provided in the base web (6) in such a way that the tongue is provided in the area in front of the insulation displacement terminal (21) and extends to the rear as far as the snap-lock edge (6*f*) and is bent up at an angle out of the plane of the base web (6).

13. Contact spring plug according to claim 1, characterized in that a snap-lock wall (30*a*, 31*a*) is provided on each side in the bottom area (32*a*) and the snap-lock walls (30*a*, 31*a*) are inclined at an angle inward and are at approximately the same level as the supporting webs (39) and the snap-lock walls (30*a*, 31*a*) have snap-lock strips (41) pointing inward in the upper end with a steep upper slope (42*a*) and a shallower lower slope (42*b*), and between two terminal webs (50*a*, 51*a*) extending from top to bottom on the cube-shaped body (48) there is a recess (57), and on the surface of each recess (57) there are two mating snap-lock strips (58, 59) parallel to each other and positioned some distance apart in the longitudinal direction of the plug, having slopes (59*a*, 58*a*) as well as (59*b*, 58*b*) that correspond to the slopes (42*b* and 42*a*) of the snap-lock strips (42) of the snap-lock walls (30*a*, 31*a*).

14. Contact spring plug according to claim 13, characterized in that one snap-lock strip (48) does not project as far as the other snap-lock strip (59).

15. Contact spring plug according to claim 13, characterized in that a plug slit (43) provided as a recess between snap-lock walls (30*a*, 31*a*) and (30, 31) in the bottom area (32*a*) is designed so it is broader than the bottom (32) by approximately the thickness of the snap-lock walls (30*a*, 31*a*) so the snap-lock walls (30*a*, 31*a*) project farther toward the outside and a plug web (44) that springs outward is provided to form each plug slit (43), and one web (51*a*) sits in a form fitting positive locking manner between the plug web (44) and snap-lock walls (30*a*, 31*a*).

16. Contact spring plug according to claim 15, characterized in that the inside faces (50*b*, 51*b*) of the webs (50*a*, 51*a*) have a slight conical taper toward the inside, and the opposite outer edge of faces of snap-lock walls (30*a*, 31*a*) run accordingly thus resulting in a form fit, preferably also a force fit.

* * * * *